US007481843B2

(12) United States Patent
Xu

(10) Patent No.: US 7,481,843 B2
(45) Date of Patent: Jan. 27, 2009

(54) PROCESS FOR THE EXTRACTION AND PREPARATION OF BAST FIBERS, BAST FIBERS OBTAINED THEREFROM AND THEIR USE

(76) Inventor: Meirong Xu, No. 635 Dashanxicun, Anchang Town, Shaoxing, Zhejiang Province 312080 (CN)

( * ) Notice: Subject to any disclaimer, the term of this patent is extended or adjusted under 35 U.S.C. 154(b) by 255 days.

(21) Appl. No.: 11/555,134

(22) Filed: Oct. 31, 2006

(65) Prior Publication Data

US 2007/0094810 A1 May 3, 2007

(30) Foreign Application Priority Data

Nov. 1, 2005 (CN) ..... 2005 1 0117221

(51) Int. Cl.
*D01C 1/02* (2006.01)
*D06L 3/14* (2006.01)

(52) U.S. Cl. ..... 8/116.1; 8/101; 8/109; 8/108.1; 8/115.51; 252/8.81; 252/8.86

(58) Field of Classification Search ..... 8/115.51, 8/101, 107, 108.1, 109, 111; 536/2; 435/275, 435/277, 278, 279, 917
See application file for complete search history.

(56) References Cited

U.S. PATENT DOCUMENTS 2,107,297 A * 2/1938 Kauffmann ..... 8/111
2,639,988 A * 5/1953 Zeehuisen ..... 162/20
4,617,383 A * 10/1986 Jaskowski ..... 536/2
6,136,041 A * 10/2000 Jaschinski et al. ..... 8/111

FOREIGN PATENT DOCUMENTS

| | | |
|---|---|---|
| CN | 1197855 | 11/1998 |
| CN | 1563541 | 1/2005 |
| CN | 1584185 | 2/2005 |
| DE | 1419355 A * | 10/1968 |
| GB | 339550 | 12/1930 |
| GB | 489496 | 7/1938 |
| GB | 650972 | 3/1951 |

OTHER PUBLICATIONS

Derwent Abstract of DE 1419355 A: Acc. No. 1987-116721, "Bleaching bast fibers, opt. mixed with other fibers, in two stages using aq. solution of chlorine dioxide in first stage, and alkaline solution of chlorine or peroxide in second stage."*
H.M. Wang and R. Postle, R.W. Kessler and W. Kessler, "Removing Pectin and Lignin During Chemical Processing of Hemp for Textile Applications" Textile Research Journal 73(8), 664-669 (2003).*
Derwent Abstract for DE 1419355 A, Oct. 1968, Jaenecke.*
Database WPI Week 200317 Thomson Scientific, London, GB; AN 2003-173568, Sep. 27, 2002.

* cited by examiner

*Primary Examiner*—David R Sample
*Assistant Examiner*—Katie Hammer
(74) *Attorney, Agent, or Firm*—Workman Nydegger

(57) ABSTRACT

The present invention generally relates to a process for the extraction and preparation of bast fibers with high quality and high counts. The process is suitable for ramie, hemp and flax. The present invention also relates to bast fibers with high counts produced according to the process, as well as pure yarns and mixed, blended yarns made from said bast fibers.

5 Claims, No Drawings

PROCESS FOR THE EXTRACTION AND PREPARATION OF BAST FIBERS, BAST FIBERS OBTAINED THEREFROM AND THEIR USE

TECHNICAL FIELD

The present invention relates to a process for the extraction and preparation of bast fibers, and bast fiber products of high quality obtained therefrom, as well as the use of said bast fiber products. The "bast" herein refers to wild or planted ramie, flax and hemp.

BACKGROUND OF THE INVENTION

China is one of the countries most abundant in bast resources in the world. In China, not only are there plenty of bast resources, but also the productive capacity in the bast textile industry is great and textile products are various. Currently, bast textiles in China mainly comprise ramie textiles, flax textiles, hemp textiles, apocynum textiles, jute textiles, sisal textiles, and so on.

Among the novel textiles for healthy, secure and disease-prevention purposes, many of the functional bast textiles developed from ramie, flax, hemp and other bast fibers are not only the environment-friendly products which meet the green consumption requirement, but also have been known as a typical healthy textiles. However, in the prior art of the process for the extraction and preparation of bast fibers, there exist such problems as roughness of the bast fibers, low metric counts, inability to obtain bast yarns of high counts and high quality, and poor dyeing property of bast fibers. And also there exists such problems as imperfect fiber degumming technology, high degrees of structural crystallization and orientation of the fiber per se, large waste of water and large environment pollution during the preparation of bast fibers. In the extraction and preparation of bast fibers, improper processing procedure damages fibers largely, resulting in a low yield of fibers and therefore a low economic benefit. Thus, there exists a need for improving process for the extraction and preparation of bast fibers, in order to obtain satisfactory bast fibers of high quality, and further to obtain textiles of high quality from said bast fibers.

SUMMARY OF THE INVENTION

It is an object of the invention to provide a process for the extraction and preparation of bast fibers, as well as bast fibers of high quality obtained therefrom, and pure yarn, blended yarn, and the mixtures of bast fibers and other fibers (such as the raw materials of non-woven fabrics) made of said bast fibers, in order to overcome the above various problems existed in the prior art.

The main reason for the inability of the existing bast fibers to be spun into yarns of high counts and high quality is that, bast fibers contain much of pectin, pigment, wax, lignin and the like. Pectin and the other components adhere to each other and are enwrapped on the surface and inside of the fibers, so that it is difficult to effectively separate and drawing the fibers. Lignin embrittles fibers, imparts poor hand feeling and pale colors to the fibers. Bast fiber molecules have high degrees of structural crystallization and orientation per se. All these make the elasticity and flexibility of the fibers decreased greatly. The current processes for the extraction and preparation of bast fibers fail to well solve the above-mentioned problems, and cause such problems as damages to the fiber strength, and difficulty to control the optimum looseness degree, resulting in difficulty to obtain bast fibers of high quality.

a) Ramie fibers

As to the ramie fibers, the current degumming process to obtain single fiber is mainly by alkali boiling, which mainly comprises boiling twice, boiling twice and scouring once, boiling twice and bleaching once, boiling twice and bleaching once and scouring once. The fibers thus obtained have a fineness of 1500-1800 Nm, and a length of 50-60 mm. The fibers have poor flexibility, and the pure yarns can only be spun up to be $21^S$(counts, Ne), which is far from the market's requirement.

The process for the extraction and preparation of bast fibers according to the present invention can solve the problems existed in the prior art and therefore obtains practical yarns of high-counts fiber in the industrial application. The process according to the present invention may be referred to boiling twice and bleaching twice and high-temperature loosening. Fibers of 2500-4500 Nm, and even above 4500 Nm are obtained by using the process. The fibers thus obtained have fewer degrees of molecular orientation and crystallization, good bulkiness, and improved crimpness.

The fibers are further loosened to split the surface of the fibers by using the present process, so that the fibers obtained is finer than the original fiber by around 30%, and have bulky structures inside and soft hand feeling.

b) Flax fibers

As to the flax fibers, the process of linen roves (that is, boiling once and bleaching once) is mainly adopted presently to obtain the semi-degummed bundle fibers, which are then spun by special apparatus for linens to produce yarns with the highest counts of $30^S$ on the current scale.

By use of the present process of boiling twice and bleaching twice and high-temperature loosening, it is possible to obtain bundle fibers of 3500-5000 Nm, and even above 5000 Nm, and the length of the fibers can be controlled according to the required yarn counts. The fibers obtained have bulky structures and improved crimpness, and can be spun on the cotton spinning machines.

By use of the process of the present invention, it is possible to obtain suitable contents of pectin and wax, and to ensure the fineness and the length of bundle fibers adapting to the conditions of the cotton spinning machines, and to remove lignin, hemicellulose and other impurities to the maximum.

c) Hemp fibers

At present, the spinning of the hemp fibers is achieved by two methods. One is to spin long fibers obtained by mechanical carding on the flax spinning machines, and then to obtain bundle fibers by rove scouring and bleaching (boiling once and bleaching once), which are conventionally spun to be up to $16^S$. The other is to obtain fibers by degumming ramies (alkali scouring and bleaching), which are then spun on the cotton spinning machines, to be up to $16^S$.

By use of the present process, it is possible to obtain bundle fibers of 2600-3800 Nm, and even above 3800 Nm suitable for spinning, and the length of the fibers can be controlled according to the required yarn counts. The fibers thus obtained have bulky structures and improved crimpness, and all the fibers can be spun on the cotton spinning machines.

By use of the present process, it is possible to obtain suitable contents of pectin and wax, and to ensure the fineness and length of bundle fibers adapting to the processing conditions of the cotton spinning machines, and to remove lignin, hemicellulose and other impurities to the maximum.

The process for the extraction and preparation of bast fibers of high quality and high counts according to the invention is referred to as boiling twice and bleaching twice and high-temperature loosening method, and may be used for ramie, hemp and flax, characterized in that, the extraction and preparation of bast fibers comprise two times of bleaching, two times of alkali boiling, and the step of high-temperature loosening, wherein the two times of bleaching are chlorine bleaching and oxygen bleaching respectively, and in the chlorine bleaching, sodium hypochlorite having a concentration of 3-8 g/L is used, the temperature is 35-45° C., and the duration is 40-80 minutes; in the oxygen bleaching, hydrogen peroxide of 4-6 g/L is used, the temperature is 80-100° C., and the duration is 40-80 minutes; in the alkali boilings, the first alkali boiling is performed by use of caustic soda; high-temperature loosening is performed after the two times of boiling and the two times of bleaching, and in the high-temperature loosening, soda of 100-140 g/L is used, the temperature is 100-140° C., and the duration is 1.5-2.5 hours.

In the case of ramie fibers, the process comprises the following specific steps:

Procedure 1:

pickling→washing with water→boiling for the first time→washing with water→bleaching for the first time→washing with acid→boiling for the second time→washing with water→bleaching for the second time→loosening at high temperature→washing with water→oiling→dehydrating→drying;

Note 1: Description of Extraction and Preparation of Ramie Fibers According to Procedure 1

Ramie fiber is a single fiber composed of one cell, the fiber length of which is the longest among the bast fibers. Bast fibers contain much of pectin, wax, lignin and the other impurities which are adverse in respect to spinning yarns of high quality and high counts. It is possible to effectively extract and prepare ramie fibers according to above procedure, wherein the steps are described in details as follows:

a. Pickling

In the pickling, pigment and other impurities on the surface of the fibers are removed, and part of pectin, wax, and lignin are dissolved. After much experiments, the present inventor find that good technical effect can be achieved by controlling the concentration of sulfuric acid to be 2-10 g/L, the temperature to be 40-60° C., and the duration to be 1-2 hours. Depending on the content of impurities in the ramie materials, the concentration of sulfuric acid can be adjusted accordingly. For the raw materials with high impurity content, the concentration of sulfuric acid can be slightly higher within the above range; and for the raw materials with low impurity content, the concentration of sulfuric acid can be slightly lower within the above range.

Preferably, the concentration of sulfuric acid is controlled to be 4-8 g/L, the temperature is controlled to be 45-55° C., and the duration is controlled to be 75-110 minutes, in which case better effect can be achieved in respect of removing pigment and dissolving.

b. Alkali boiling

There are two times of alkali boiling, that is, boiling for the first time and boiling for the second time in the above procedure. The purpose of alkali boiling is to further dissolve pectin, wax, lignin and other impurities as well as hemicellulose on the surface of the fibers, and to obtain bulky fiber tissue and soft hand feeling. For this purpose, the alkali boiling conditions are controlled to be 50-150 g/L of caustic soda, 1.5-2 hours of duration and 90-140° C. of temperature (the temperature is relatively high, in order to obtain bulkier fiber tissue, resulting in the penetration of caustic soda into the inside of the fibers and thereby remove the impurities). In this way, better alkali boiling effect can be obtained, and the fiber tissue obtained is bulkier, and then caustic soda penetrates into the inside of the fibers and effectively remove impurities.

Preferably, better technical effect can be obtained when the alkali boiling conditions are set as follows: 70-120 g/L of caustic soda, 100-115 minutes of duration, and 110-1300° C. of temperature.

c. Bleaching

Bleaching is performed twice, in which bleaching for the first time is chlorine bleaching in order to remove impurities from the fibers, especially lignin in the fibers. Obtained fibers are fair-skinned and have soft hand feeling. In the chlorine bleaching, sodium hypochlorite having a concentration of 3-8 g/L (gram/liter) is used, the temperature is 35-45° C., and the duration is 40-80 minutes. Bleaching for the second time is oxygen bleaching in order to make the structure bulkier and the fibers smoother, and to make the adhered impurities separated from the fibers. Obtained fibers may be effectively loosened and readily be drawn. In the oxygen bleaching, hydrogen peroxide of 4-6 g/L is used, the temperature is 80-100° C., and the duration is 40-80 minutes.

Preferably, in the chlorine bleaching, sodium hypochlorite having a concentration of 4-7 g/L is used, the temperature is 35-45° C., and the duration is 50-70 minutes; and in the oxygen bleaching, hydrogen peroxide of 4-6 g/L is used, the temperature is 80-100° C., and the duration is 55-75 minutes. Under this condition, better bleaching effect can be obtained.

d. High-temperature loosening

The purpose of high-temperature loosening is to make fibers separated thoroughly, in which case the fineness of fibers is controlled depending on duration and temperature. The present inventor find that excellent loosening effect can be obtained by use of 100-140 g/L of soda at 100-140° C. for 1.5-2.5 hours, in which case the fibers are loosened thoroughly and fibers of uniform fineness are obtained.

Preferably, in the high-temperature loosening, 110-130 g/L of soda is used, the temperature is 10-135° C., and the duration is 100-140 minutes.

e. Oiling

Oiling is known for the skilled in the art and may be carried out according to the conventional manner. In particularly, vegetable oil is used in an amount of 1-2% by weight of fiber mass, in order to make the fibers not adhering to each other and softer. Obtained fibers have improved flexibility, smoothness and softness.

The technical bath ratio in the above steps is maintained to be 1:10-20 (i.e., 10-20 kilograms solution per one kilogram fiber).

With respect to the extraction and preparation of flax and hemp fibers, the process comprised the following specific steps:

Procedure 2:

Purification→pickling→washing with water→bleaching for the first time→boiling for the first time→washing with water→bleaching for the second time→boiling for the second time→loosening at high temperature→washing with water→oiling→dehydrating→drying Note 2: Description of Extraction and Preparation of Flax and Hemp Fibers According to Procedure 2

Both flax and hemp fibers are in the form of bundle fibers, in which many single fibers are adhered to each other by pectin. The fibers also contain much of wax, lignin, hemicellulose and other impurities. The key of the present invention is to effectively remove the above-mentioned impurities, but retain suitable content of pectin which is adaptable to spinning. Thus obtained fibers have the length and the fineness able to be spun into high-counts yarns.

a. Pickling and purification

In the pickling, pigment and other impurities on the surface of the fibers are removed, and part of pectin, wax, lignin and other impurities are dissolved. The pickling step is carried out by use of 2-10 g/L of sulfuric acid, 40-60° C. of temperature and 1-2 hours of duration. Depending on the content of the impurities in the raw materials, the concentration of sulfuric acid can be adjusted accordingly. For the raw materials with high impurity content, the concentration of sulfuric acid can be slightly higher within the above range; and for the raw materials with low impurity content, the concentration of sulfuric acid can be slightly lower within the above range.

In the present invention, it is also possible to extract useful elements, such as resin, through the elemental purification from soaked solutions, so as to obtain better economic benefit.

b. Boiling for the first time

Boiling for the first time means alkali boiling of raw materials, in order to dissolve pectin, wax, lignin and other impurities as well as hemicellulose on the surface of the fibers, and to obtain bulky fiber tissue and soft hand feeling. For this purpose, the conditions of boiling for the first time are controlled to be 25-100 g/L of caustic soda, 1-1.5 hours of duration and 60-90° C. of temperature (the temperature is relatively high, in order to obtain bulkier fiber tissue, resulting in the penetration of caustic soda into the inside of the fibers and thereby remove the impurities). In this way, better alkali boiling effect can be obtained, and the fiber tissue obtained is bulkier, and then caustic soda penetrates into the inside of the fibers and effectively remove impurities.

Preferably, better technical effect can be obtained when the conditions of boiling for the first time are set as follows: 40-80 g/L of caustic soda, 70-85 minutes of duration, and 70-85° C. of temperature.

c. Bleaching

Bleaching is performed twice, in which bleaching for the first time is chlorine bleaching in order to remove impurities from the fibers, especially lignin in the fibers. Obtained fibers are fair-skinned and have soft hand feeling. In the chlorine bleaching, sodium hypochlorite having a concentration of 3-8 g/L (gram/liter) is used, the temperature is 35-45° C., and the duration is 40-80 minutes. Bleaching for the second time is oxygen bleaching in order to make the structure bulkier and the fibers smoother, and to make the adhered impurities separated from the fibers. Obtained fibers may be effectively loosened and readily be drawn. In the oxygen bleaching, hydrogen peroxide of 4-6 g/L is used, the temperature is 80-100° C., and the duration is 40-80 minutes.

Preferably, in the chlorine bleaching, sodium hypochlorite having a concentration of 4-7 g/L is used, the temperature is 35-45° C., and the duration is 50-70 minutes; and in the oxygen bleaching, hydrogen peroxide of 4-6 g/L is used, the temperature is 80-100° C., and the duration is 55-75 minutes. Under this condition, better bleaching effect can be obtained.

d. Boiling for the second time

The purpose of boiling for the second time is to further remove impurities and obtain fibers with soft hand feeling, without destroying fibers. In this case, soda of 60-90 g/L is used, the duration is 1-1.5 hours, and the temperature is 100-130° C.

Preferably, better technical effect can be obtained when the conditions of boiling for the second time are set as follows: 70-85 g/L of soda, 70-85 minutes of duration, and 110-130° C. of temperature.

After pickling, alkali boiling twice (boiling for the first time and boiling for the second time), the content of resin in the bast fibers is retained at about 1-3%.

e. High-temperature loosening

The purpose of high-temperature loosening is to make fibers separated thoroughly, in which case the fineness of fibers is controlled depending on duration and temperature. The present inventor find that excellent loosening effect can be obtained by use of 100-140 g/L of soda at 100-140° C. for 1.5-2.5 hours, in which case the fibers are loosened thoroughly and fibers of uniform fineness are obtained.

Preferably, in the high-temperature loosening, 110-130 g/L of soda is used, the temperature is 110-135° C., and the duration is 100-140 minutes.

f. Oiling

Oiling is known for the skilled in the art and may be carried out according to the conventional manner. In particularly, vegetable oil is used in an amount of 1-2% by weight of fiber mass, in order to make the fibers not adhering to each other and softer. Obtained fibers have improved flexibility, smoothness and softness.

The technical bath ratio in the above steps is maintained to be 1:10-20.

Bast fiber products made by the present invention have the following parameters.

TABLE 1

| | Linear density (dtex) | Length (mm) | Breaking strength (cn/dtex) | Break elongation (%) |
|---|---|---|---|---|
| Ramie | 3.3 | 60 | 4.4 | 6.2 |
| Flax | 3.0 | 41 | 4.2 | 7.1 |
| Hemp | 3.7 | 37 | 3.7 | 5.8 |

The bast fibers of the present invention are better than the bast fibers produced according to the prior art on the above parameters. For example, in the prior art, the linear density of ramie, flax and hemp fibers is generally 7.5, 7.0 and 9.5-10.0 (dtex) respectively, while in the present invention, the measured linear density is 3.3, 3.0 and 3.7 (dtex), respectively.

According to the present invention, the following bast fibers, pure bast yarns and mixed, blended yarns with excellent properties can be obtained.

i) Ramie Fibers a. The ramie fibers prepared according to the present invention are generally of above 2500 Nm, preferably 2500-4500 Nm, and more preferably above 4500 Nm. The ramie fibers have fewer degrees of molecular orientation and crystallization, good bulkiness and improved crimpness. Pure ramie yarns of $32^S$-$60^S$ and even above $60^S$ can be spun from the fibers.

b. The ramie fibers prepared according to the present invention can be mixed or blended with animal fibers, plant fibers and chemical fibers in various proportion to be spun into mixed, blended yarns of above $40^S$, preferably $40\text{-}120^S$, and more preferably above $120^S$.

c. The ramie fibers prepared according to the present invention can directly be dyed, mixed and blended with various fibers. Thus, the quality of pure bast textiles and blended is improved and the spinning procedure is simplified.

The yield of the present process is higher than that of the conventional process by about 10%. Pectin in the boiling solution can be extracted and purified for further processing. The bast textiles produced according to the present process are smooth and comfortable, and have improved wrinkle resistance.

ii) Flax fibers a. The flax fibers prepared according to the present invention can be bundle fibers of 3500-5000 Nm, and preferably above 5000 Nm, and the length of fibers is controlled according to the spinning requirements. Pure flax yarns of $32^S\text{-}80^S$ and preferably above $80^S$ can be spun from the flax fibers.

b. The flax fibers prepared according to the present invention can be mixed or blended with animal fibers, plant fibers and chemical fibers in various proportion to be spun into mixed, blended yarns of $40^S\text{-}120^S$.

c. The flax fibers prepared according to the present invention can directly be dyed, mixed and blended with various fibers. Thus, the quality of pure bast textiles and blended is improved and the spinning procedure is simplified.

The present invention not only provides the possibility of the production of flax yarns with high counts, but also reduces the installation cost by above 60%, shortens the technological route, and thus improves productivity.

iii) Hemp fibers a. Hemp bundle fibers of 2600-3800 Nm and preferably above 3800 Nm can be obtained according to the present invention. The softness and warmness of the fibers according to the present invention is close to that of cashmeres. The UV resistance of the textiles obtained is remarkable. Pure hemp yarns of $18^S\text{-}60^S$ and preferably above $60^S$ can be spun from said fibers.

b. The hemp fibers prepared according to the present invention can be mixed or blended with animal fibers, plant fibers and chemical fibers in various proportion to be spun into mixed, blended yarns of $21^S\text{-}80^S$.

c. The hemp fibers prepared according to the present invention can directly be dyed, mixed and blended with various fibers.

d. It is possible to extract and purify the pharmaceutical materials from the boiling solution, and to prepare various medicaments.

PREFERRED EMBODIMENTS OF THE INVENTION

The invention will be described in more details with reference to specific embodiments. It should be noted that the following examples are only demonstrative, and don't mean limit the scope of the invention in any way. The present invention is limited by the appended claims and the equivalents thereof.

EXAMPLE 1

Extraction and Preparation of Bast Fibers

Ramie, hemp and flax raw materials are pretreated respectively. The extraction and preparation procedure comprises two times of bleaching, two times of alkali boiling, and the step of high-temperature loosening. Bleaching comprises chlorine bleaching and oxygen bleaching. In the chlorine bleaching, sodium hypochlorite having a concentration of 6 g/L is used, the temperature is 40° C., and the duration is 60 minutes. In the oxygen bleaching, hydrogen peroxide of 5 g/L is used, the temperature is 92° C., and the duration is 60 minutes. Alkali boiling is performed two times, and the first time is performed by use of caustic soda. High-temperature loosening is performed after boiling and bleaching. In the high-temperature loosening, soda of 120 g/L is used, the temperature is 120° C., and the duration is 2 hours.

EXAMPLE 2

Extraction and Preparation of Bast Fibers

Ramie, hemp and flax raw materials are pretreated respectively. The extraction and preparation procedure comprises two times of bleaching, two times of alkali boiling, and the step of high-temperature loosening. Bleaching comprises chlorine bleaching and oxygen bleaching. In the chlorine bleaching, sodium hypochlorite having a concentration of 8 g/L is used, the temperature is 35° C., and the duration is 80 minutes. In the oxygen bleaching, hydrogen peroxide of 6 g/L is used, the temperature is 85° C., and the duration is 80 minutes. Alkali boiling is performed two times, and the first time is performed by use of caustic soda. High-temperature loosening is performed after boiling and bleaching. In the high-temperature loosening, soda of 100 g/L is used, the temperature is 140° C., and the duration is 1.5 hours.

EXAMPLE 3

Extraction and Preparation of Ramie Fibers, and the Preparation of Pure Yarns and Blended Yarns Pickling the ramie raw materials, with the concentration of sulfuric acid of 5 g/L, the temperature of 55° C., and the duration of 90 minutes.

Fishing out the ramie materials, and washing it with water.

Alkali boiling the ramie materials for the first time, with the conditions of 90 g/L of caustic soda, 110 minutes of duration and 120° C. of temperature.

Washing the boiled ramie materials with water.

Chlorine bleaching the ramie materials, with 5 g/L of sodium hypochlorite at 40° C. for 60 minutes.

Washing the ramie materials with acid, to remove chlorine ions remained after chlorine bleaching.

Alkali boiling the ramie materials for the second time, with the same condition as in the first alkali boiling.

Washing the ramie materials with water again.

Oxygen bleaching the ramie materials with 5 g/L of hydrogen peroxide at 90° C. for 60 minutes.

High-temperature loosening the ramie materials with 120 g/L of soda at 120° C. for 120 minutes.

Washing the ramie fibers with water.

Oiling the ramie fibers with vegetable oil in an amount of 1.5% by weight of the fiber mass.

Technical bath ratio in the above steps is 1:15.

Dehydrating the oiled fibers and then drying, to produce final ramie fibers with a linear density of 3.0 dtex (3300 Nm).

The produced ramie fibers are spun according to conventional process, yielding pure ramie yarns of $40^S$.

The produced ramie fibers are subjected to blended spinning with American long-staple cotton fiber according to conventional process, yielding blended yarns of $80^S$ (bast fiber of 55%, cotton fiber of 45%).

In the above steps, all the procedures without specific description are the conventional procedures known to the skilled in the art.

EXAMPLE 4

Extraction and Preparation of Ramie Fibers, and the Preparation of Pure Yarns and Blended Yarns Unless otherwise noted, the procedure in this example is same as Example 3.

In pickling, the concentration of sulfuric acid is 10 g/L, the temperature is 45° C., and the duration is 60 minutes.

In first boiling, the conditions are 50 g/L of caustic soda, 120 minutes of duration and 110° C. of temperature.

In chlorine bleaching, the conditions are 8 g/L of sodium hypochlorite, 35° C. of temperature and 80 minutes of duration.

In oxygen bleaching, the conditions are 4 g/L of hydrogen peroxide, 100° C. of temperature and 70 minutes of duration.

In high-temperature loosening, the conditions are 130 g/L of soda, 135° C. of temperature and 120 minutes of duration.

In oiling, vegetable oil is used in an amount of 1.8% by weight of the fiber mass.

Technical bath ratio in the above steps is 1:20.

The linear density of the ramie fibers obtained is 2.5 dtex (4000 Nm).

The produced ramie fibers are spun on textile machines according to conventional process, yielding pure ramie yarns of $48^S$.

The produced ramie fibers are subjected to blended spinning with Ameircan long-staple cotton fiber according to conventional process, yielding blended yarns of $100^S$ (bast fiber of 55%, cotton fiber of 45%).

EXAMPLE 5

Extraction and Preparation of Ramie Fibers, and the Preparation of Pure Yarns and Blended Yarns Unless otherwise noted, the procedure in this example is same as Example 3.

In pickling, the concentration of sulfuric acid is 4 g/L, the temperature is 55° C., and the duration is 75 minutes.

In first boiling, the conditions are 70 g/L of caustic soda, 115 minutes of duration and 120° C. of temperature.

In chlorine bleaching, the conditions are 7 g/L of sodium hypochlorite, 40° C. of temperature and 55 minutes of duration.

In oxygen bleaching, the conditions are 6 g/L of hydrogen peroxide, 80° C. of temperature and 75 minutes of duration.

In high-temperature loosening, the conditions are 110 g/L of soda, 135° C. of temperature and 130 minutes of duration.

In oiling, vegetable oil is used in an amount of 2.0% by weight of the fiber mass.

Technical bath ratio in the above steps is 1:10.

The linear density of the ramie fibers obtained is 2.0 dtex (5000 Nm).

The produced ramie fibers are spun on textile machines according to conventional process, yielding pure ramie yarns of $48^S$.

The produced ramie fibers are subjected to blended spinning with cashmere fibers according to conventional process, yielding blended yarns of $100^S$ (bast fiber of 40%, cashmere fibers of 60%).

EXAMPLE 6

Extraction and Preparation of Flax Fibers, and the Preparation of Pure Yarns and Blended Yarns Pickling and purifying the flax materials, with the conditions of 5 g/L of sulfuric acid, 50° C. of temperature and 90 minutes of duration.

Washing the flax materials with water.

Chlorine bleaching is used to remove impurities, especially lignin from the fibers. In chlorine bleaching, 5 g/L of sodium hypochlorite is used, the temperature is 40° C., and the duration is 60 minutes.

Alkali boiling the flax materials for the first time, with the conditions of 60 g/L of caustic soda, 75 minutes of duration and 80° C. of temperature.

Washing the flax materials with water again.

Bleaching the flax materials with hydrogen peroxide. In oxygen bleaching, 5 g/L of hydrogen peroxide is used, the temperature is 90° C., and the duration is 60 minutes.

Alkali boiling the flax materials again, with the conditions of 75 g/L of soda, 75 minutes of duration and 130° C. of temperature.

High-temperature loosening the flax materials with 120 g/L of soda at 120° C. for 120 minutes.

Washing the flax fibers with water.

Oiling the flax fibers with vegetable oil in an amount of 1.5% by weight of the fiber mass.

Technical bath ratio in the above steps is 1:15.

Dehydrating the oiled fibers and then drying, to produce final flax fibers with a linear density of 3.0 dtex (3300 Nm).

The produced flax fibers are spun on textile lines, yielding pure flax yarns of $40^S$.

The produced flax fibers are subjected to blended spinning with Sinkiang long-staple cotton fiber, yielding flax/cotton blended yarns of $80^S$ (flax fiber of 55%, cotton fiber of 45%).

In the above steps, all the procedures without specific description are the conventional procedures known to the skilled in the art.

EXAMPLE 7

Extraction and Preparation of Flax Fibers, and the Preparation of Pure Yarns and Blended Yarns Unless otherwise noted, the procedure in this example is same as Example 6.

The conditions of pickling are 10 g/L of sulfuric acid, 40° C. of temperature, and 60 minutes of duration.

In chlorine bleaching, the conditions are 7 g/L of sodium hypochlorite, 35° C. of temperature, and 50 minutes of duration.

In first boiling, the conditions are 40 g/L of caustic soda, 85 minutes of duration and 85° C. of temperature.

In oxygen bleaching, the conditions are 4 g/L of hydrogen peroxide, 100° C. of temperature and 55 minutes of duration.

In second boiling, the conditions are 60 g/L of soda, 90 minutes of duration and 115° C. of temperature.

In high-temperature loosening, the conditions are 130 g/L of soda, 135° C. of temperature, and 100 minutes of duration.

Oiling with vegetable oil in an amount of 1.8% by weight of the fiber mass.

Technical bath ratio in the above steps is 1:10.

The linear density of the flax fibers obtained is 2.4 dtex (4160 Nm).

The produced flax fibers are spun to yield pure flax yarns of $60^S$.

The produced flax fibers are subjected to blended spinning with Ameircan long-staple cotton fiber on textile machines, yielding blended yarns of $100^S$ (flax fiber of 55%, cotton fiber of 45%).

EXAMPLE 8

Extraction and Preparation of Flax Fibers, and the Preparation of Pure Yarns and Blended Yarns Unless otherwise noted, the procedure in this example is same as Example 6.

The conditions of pickling are 2 g/L of sulfuric acid, 60° C. of temperature, and 100 minutes of duration.

In chlorine bleaching, the conditions are 3 g/L of sodium hypochlorite, 45° C. of temperature, and 80 minutes of duration.

In first boiling, the conditions are 80 g/L of caustic soda, 60 minutes of duration and 70° C. of temperature.

In oxygen bleaching, the conditions are 6 g/L of hydrogen peroxide, 80° C. of temperature and 75 minutes of duration.

In second boiling, the conditions are 90 g/L of soda, 60 minutes of duration and 70° C. of temperature.

In high-temperature loosening, the conditions are 100 g/L of soda, 140° C. of temperature, and 100 minutes of duration.

Oiling with vegetable oil in an amount of 1.2% by weight of the fiber mass.

Technical bath ratio in the above steps is 1:10.

The linear density of the flax fibers obtained is 2.0 dtex (5000 Nm).

The produced flax fibers are spun to yield pure flax yarns of $80^S$.

The produced flax fibers are subjected to blended spinning with silk fiber, yielding blended yarns of $100^S$ (flax fiber of 55%, silk fiber of 45%).

EXAMPLE 9

Extraction and Preparation of Hemp Fibers, and the Preparation of Pure Yarns and Blended Yarns The extraction and preparation of hemp fibers are same as Example 6, except that flax is replaced with hemp.

The linear density of final hemp fibers obtained is 3.7 dtex (2700 Nm).

The produced hemp fibers are spun to yield pure hemp yarns of $21^S$.

The produced hemp fibers are subjected to blended spinning with cotton fibers, yielding blended yarns of $40^S$ (hemp fiber of 55%, cotton fiber of 45%).

In the above steps, all the procedures without specific description are the conventional procedures known to the skilled in the art.

EXAMPLE 10

Extraction and Preparation of Hemp Fibers, and the Preparation of Pure Yarns and Blended Yarns The extraction and preparation of hemp fibers are same as Example 7, except that flax is replaced with hemp.

The linear density of the hemp fibers obtained is 3.0 dtex (3300 Nm). Said fibers are dyed. The dyed hemp fibers are spun to yield colored yarns of $40^S$. The dyed hemp fibers are subjected to blended spinning with dyed cotton fibers, yielding blended yarns of $60^S$ (hemp fiber of 50%, cotton fiber of 50%).

EXAMPLE 11

Extraction and Preparation of Hemp Fibers, and the Preparation of Pure Yarns and Blended Yarns The extraction and preparation of hemp fibers are same as Example 8, except that flax is replaced with hemp.

The linear density of the hemp fibers obtained is 2.6 dtex (3850 Nm).

The produced hemp fibers are spun to yield pure hemp yarns of $60^S$.

The produced hemp fibers are subjected to blended spinning with cashmere fibers and silk fibers, yielding blended yarns of $80^S$ (hemp fiber of 30%, cashmere fibers of 40%, and silk fibers of 30%).

The invention claimed is:

1. A process for the extraction and preparation of bast fibers, comprises ramie, hemp or flax is subjected to two times of bleaching, two times of alkali boiling, and a step of high-temperature loosening, wherein the two times of bleaching are chlorine bleaching and oxygen bleaching respectively, and in the chlorine bleaching, sodium hypochlorite having a concentration of 3-8 g/L is used, the temperature is 35-45° C., and the duration is 40-80 minutes; in the oxygen bleaching, hydrogen peroxide of 4-6 g/L is used, the temperature is 80-100° C., and the duration is 40-80 minutes; in the alkali boilings, the first alkali boiling is performed by use of caustic soda; high-temperature loosening is performed after the bleaching and boiling, and in the high-temperature loosening, soda of 100-140 g/L is used, the temperature is 100-140° C., and the duration is 1.5-2.5 hours.

2. The process as claimed in claim 1, wherein said bast fibers are ramie fibers, said process comprises the following steps in order:

pickling→washing with water→boiling for the first time→washing with water→bleaching for the first time→washing with acid→boiling for the second time→washing with water→bleaching for the second time→loosening at high temperature→washing with water→oiling→dehydrating→drying;

wherein, in pickling, sulfuric acid is used and controlled to have a concentration of 2-10 g/L, the temperature is 40-60° C., and the duration is 1-2 hours;

both the first boiling and the second boiling are alkali boiling with the same conditions which are 50-150 g/L of caustic soda, 1.5-2 hours of duration and 90-140° C. of temperature;

bleaching is performed twice, and in the first bleaching, sodium hypochlorite having a concentration of 3-8 g/L is used, the temperature is 35-45° C., and the duration is 40-80 minutes; in the second bleaching, hydrogen peroxide of 4-6 g/L is used, the temperature is 80-100° C., and the duration is 40-80 minutes;

in the high-temperature loosening, soda of 100-140 g/L is used, the temperature is 100-140° C., and the duration is 1.5-2.5 hours;

oiling is performed with vegetable oil in an amount of 1-2% by weight of fiber mass;

the technical bath ratio in the above steps is 1:10-20.

3. The process as claimed in claim 2, characterized in that, in pickling, the concentration of sulfuric acid is controlled to be 4-8 g/L, the temperature is controlled to be 45-55° C., and the duration is controlled to be 75-110 minutes;

the conditions of alkali boiling are controlled to be 70-120 g/L of caustic soda, 100-115 minutes of duration and 110-130° C. of temperature;

in the first bleaching, sodium hypochlorite having a concentration of 4-7 g/L is used, the temperature is 35-45° C., and the duration is 50-70 minutes; in the second bleaching, hydrogen peroxide of 4-6 g/L is used, the temperature is 80-100° C., and the duration is 55-75 minutes;

in the high-temperature loosening, soda of 110-130 g/L is used, the temperature is 110-135° C., and the duration is 100-140 minutes.

4. The process as claimed in claim 1, wherein said bast fibers are flax or hemp fibers, said process comprises the following steps in order:

purification→pickling→washing with water→bleaching for the first time→boiling for the first time→washing with water→bleaching for the second time→boiling for the second time→loosening at high temperature→washing with water→oiling→dehydrating→drying;

wherein, in pickling and purification, 2-10 g/L of sulfuric acid is used, the temperature is 40-60° C., and the duration is 1-2 hours;

both the first boiling and the second boiling are alkali boiling with the conditions of the first boiling to be 25-100 g/L of caustic soda, 1-1.5 hours of duration and 60-90° C. of temperature;

bleaching is performed twice, and in the first bleaching, sodium hypochlorite having a concentration of 3-8 g/L is used, the temperature is 35-45° C., and the duration is 40-80 minutes;

in the second boiling, 60-90 g/L of soda is used, the duration is 1-1.5 hours, and the temperature is 100-130° C.;

in the second bleaching, hydrogen peroxide of 4-6 g/L is used, the temperature is 80-100° C., and the duration is 40-80 minutes;

in the high-temperature loosening, soda of 100-140 g/L is used, the temperature is 100-140° C., and the duration is 1.5-2.5 hours;

oiling is performed with vegetable oil in an amount of 1-2% by weight of fiber mass;

the technical bath ratio in the above steps is 1:10-20.

5. The process as claimed in claim 4, characterized in that, the conditions of the first boiling are controlled to be 40-80 g/L of caustic soda, 70-85 minutes of duration and 70-85° C. of temperature;

in the first bleaching, sodium hypochlorite having a concentration of 4-7 g/L is used, the temperature is 35-45° C., and the duration is 50-70 minutes; in the second bleaching, hydrogen peroxide of 4-6 g/L is used, the temperature is 80-100° C., and the duration is 55-75 minutes;

in the second boiling, soda is used in an amount of 70-85 g/L, the duration is 70-85 minutes, and the temperature is 110-130° C.;

in the high-temperature loosening, soda of 110-130 g/L is used, the temperature is 110-135° C., and the duration is 100-140 minutes.

* * * * *